US008652581B2

(12) United States Patent
Merchant

(10) Patent No.: US 8,652,581 B2
(45) Date of Patent: Feb. 18, 2014

(54) METHOD OF USING A SPRAY GUN AND MATERIAL PRODUCED THEREBY

(76) Inventor: Matthew Merchant, Vinton, IA (US)

( * ) Notice: Subject to any disclaimer, the term of this patent is extended or adjusted under 35 U.S.C. 154(b) by 544 days.

(21) Appl. No.: 12/771,435

(22) Filed: Apr. 30, 2010

(65) Prior Publication Data

US 2011/0084150 A1 Apr. 14, 2011

Related U.S. Application Data

(60) Provisional application No. 61/250,250, filed on Oct. 9, 2009.

(51) Int. Cl.
*B05D 1/04* (2006.01)

(52) U.S. Cl.
USPC ..... 427/475; 427/458; 427/426

(58) Field of Classification Search
USPC ..... 427/426, 458, 475
See application file for complete search history.

(56) References Cited

U.S. PATENT DOCUMENTS

| | | | | |
|---|---|---|---|---|
| 2,980,339 | A | 4/1961 | Bok | |
| 3,330,484 | A * | 7/1967 | Johnson et al. | 239/414 |
| 3,893,621 | A | 7/1975 | Johnson | |
| 3,976,248 | A * | 8/1976 | Middleton, Sr. | 239/416.1 |
| 4,262,847 | A | 4/1981 | Stitzer | |
| 4,517,222 | A * | 5/1985 | Blegen | 427/483 |
| 4,760,956 | A | 8/1988 | Mansfield | |
| 4,774,102 | A | 9/1988 | Kiefer | |
| 4,824,017 | A | 4/1989 | Mansfield | |
| 5,388,767 | A | 2/1995 | Moses | |
| 5,405,083 | A | 4/1995 | Moses | |
| 5,549,246 | A | 8/1996 | Kukesh | |
| 5,570,839 | A | 11/1996 | Kukesh | |
| 2005/0211800 | A1 | 9/2005 | Scarpa et al. | |
| 2006/0057394 | A1 | 3/2006 | Cork | |
| 2006/0115587 | A1 | 6/2006 | Davis | |
| 2007/0042126 | A1 | 2/2007 | Passman et al. | |
| 2007/0249778 | A1 | 10/2007 | Clemens et al. | |
| 2008/0087371 | A1 | 4/2008 | Friedrich et al. | |
| 2009/0008477 | A1 * | 1/2009 | Merchant | 239/305 |

FOREIGN PATENT DOCUMENTS

| | | |
|---|---|---|
| GB | 2168623 | 6/1986 |
| WO | 95/13878 | 5/1995 |

* cited by examiner

*Primary Examiner* — Frederick Parker
(74) *Attorney, Agent, or Firm* — Ryan N. Carter

(57) ABSTRACT

An apparatus for mixing a first material with a second material and then spraying the resultant material onto a surface. The second material is mixed with a gas before the being introduced to the first material. A static charge is created and deposited onto the resultant material to help align the resultant material particles.

13 Claims, 5 Drawing Sheets

METHOD OF USING A SPRAY GUN AND MATERIAL PRODUCED THEREBY

This application is related to U.S. Provisional Application Ser. No. 61/250,250 filed Oct. 9, 2009, the complete disclosure of which is hereby expressly incorporated by this reference.

BACKGROUND OF THE INVENTION

A variety of spray guns are known in the art. An internal mix gun is often used when solvent emissions are a problem, because internal mixing limits the amount of atomized material and catalyst exiting the gun. Internal mix guns generally have three feed lines, a resin line and a catalyst line which feed into a manifold, and an air line. The resin and catalyst are typically mixed in the manifold. After mixing, the resin and catalyst are expelled from the gun in confluence through a nozzle or similar orifice with pressurized air from the air line. The pressurized air supplies sufficient pressure so that the resin and catalyst are sheared and atomized as they are expelled from the gun. A major drawback of this type of gun is that during a spraying operation, catalyzed resin often backs up into and catalyzes within the air supply. Catalyzed resin in the air supply leads to costly and time-consuming down time while the spraying operation is shut down and the air supply is cleared of any obstructions. Standard check valves are rarely effective as they quickly become hardened shut with catalyzed resin or the internal workings of the check valve become frozen with catalyzed resin.

A second type of gun typically used is an external mix gun. In an external mix gun, the resin and catalyst are atomized and expelled separately and directed toward one another. The resin and catalyst combine in the air shortly before contacting the article being treated. A major drawback of the external mix gun is the incomplete mixing of resin and catalyst, which often leads to patches of incompletely catalyzed resin appearing on the finished article. Such portions of uncatalyzed resin can produce points of weakness or blisters on the surface of the finished article.

A more important problem with external mix guns is the exterior atomization of the catalyst. Because of the incomplete mixing of the catalyst with the resin, much of the atomized catalyst disperses into the atmosphere and, more particularly, in the immediate work environment where the application is taking place. Concern over the safety of workers breathing catalyst contaminated air has led to numerous restrictions on the use of external mix guns.

DETAILED DESCRIPTION OF THE INVENTION

A spray gun 10 adapted to mix and expel a first material and a second material, wherein the second material may by introduced to a gas before being mixed with the first material. The spray gun 10 is particularly beneficial when the first material has a very high viscosity and the second material has a very low viscosity, however, any suitable materials may be mixed and sprayed with the present invention. In the embodiments described herein, the first material is a resin and the second material is a catalyst, however any other suitable materials may be used. Catalysts that may be used include methyl ethyl ketone peroxide (MEKP), trimethyl, pentanediol diisobutyrate, hydrogen peroxide, organic peroxides, tert-butyl peroxiybenzoate, n-methyl-n-hydroxyothyl-p-toluidane, cobalt napthenate 9 n9n-dimethylaine, isocyanate. Resins that may be used include latex, vinyl esters, epoxies, polyesters, polyamines, urethane, and mdi tdi. In the embodiment described herein, the preferred gas is air (i.e. about 20% oxygen mixed with about 80% nitrogen), however, any other suitable reactive or nonreactive gas may be used. Reactive gases that may be used include oxygen, carbon, and chlorine. Nonreactive gases that may be used include carbon dioxide, argon, nitrogen, and helium.

The spray gun 10 may be used to spray materials onto a variety of substrates for a variety of purposes including, but not limited to the following—anti-cavitation for propellers and wastewater systems, anti-hydration surfaces for boats, bathroom toilets/showers, high temperature semi-conductor boards, heat shield for electronics, micro processing casing, interior liner for plastic piping, anti microbial surfaces, hazardous containment systems, water resistant exterior panels, increased temperature and abrasive resistant surfaces, sound deadening shields for cars, heat shield for cars, containment shields for transformers, fire protection shields, reduction of emissions in plastics, concrete water containment systems, and increased temperature and abrasive resistant piping.

Figure 1:
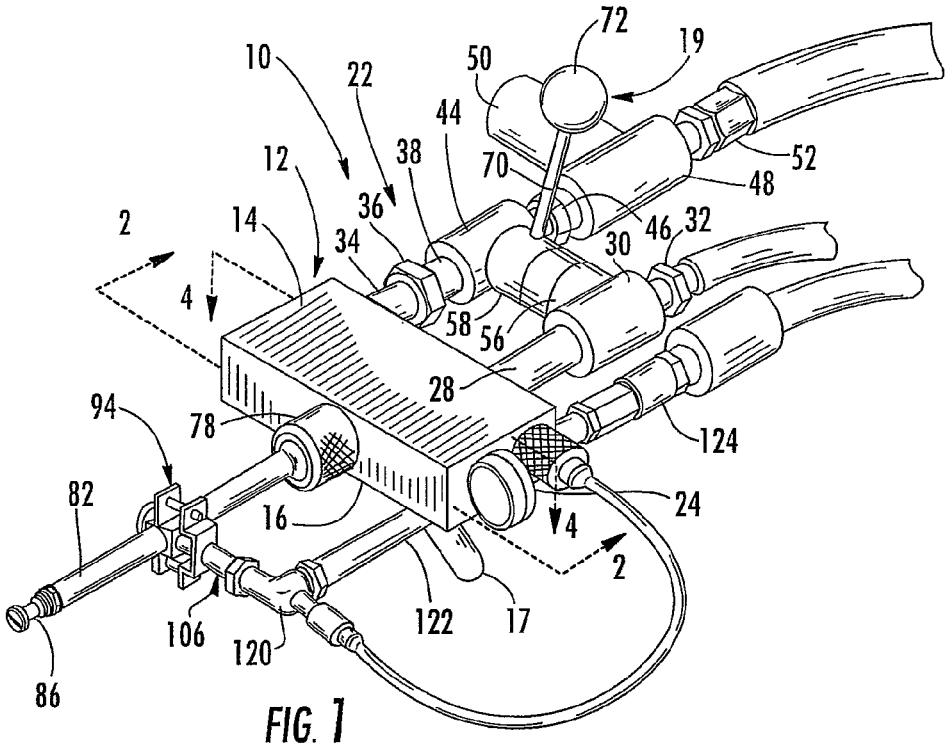
FIG. 1 is a perspective view of the spray gun.

As seen in FIG. 1, the spray gun 10 comprises a disposable static mixing tube 82 which extends from the manifold 12 and terminates in a spray tip 86. The gun 10 has an air tube 122 which is in fluid communication with the static mixing tube 82 to help atomize and spray catalyzed resin from the static mixing tube 82 through the spray tip 86. Catalyst is combined with the air supply line 122 before the air/catalyst mixture is introduced to the resin in the static mixing tube 82. In one embodiment of the present invention, the manifold 12 is a tooled aluminum block about fifteen centimeters wide, ten centimeters long, and three centimeters deep (FIG. 1). The manifold is a one-piece drilled block having a top 14 and a bottom 16. Secured to the bottom 16 of the manifold 12 is a tapered handle 17, which is preferably angled toward a switch handle 19. The angle of the handle 17 makes the gun 10 easier to hold as it is being operated.

Figure 4:
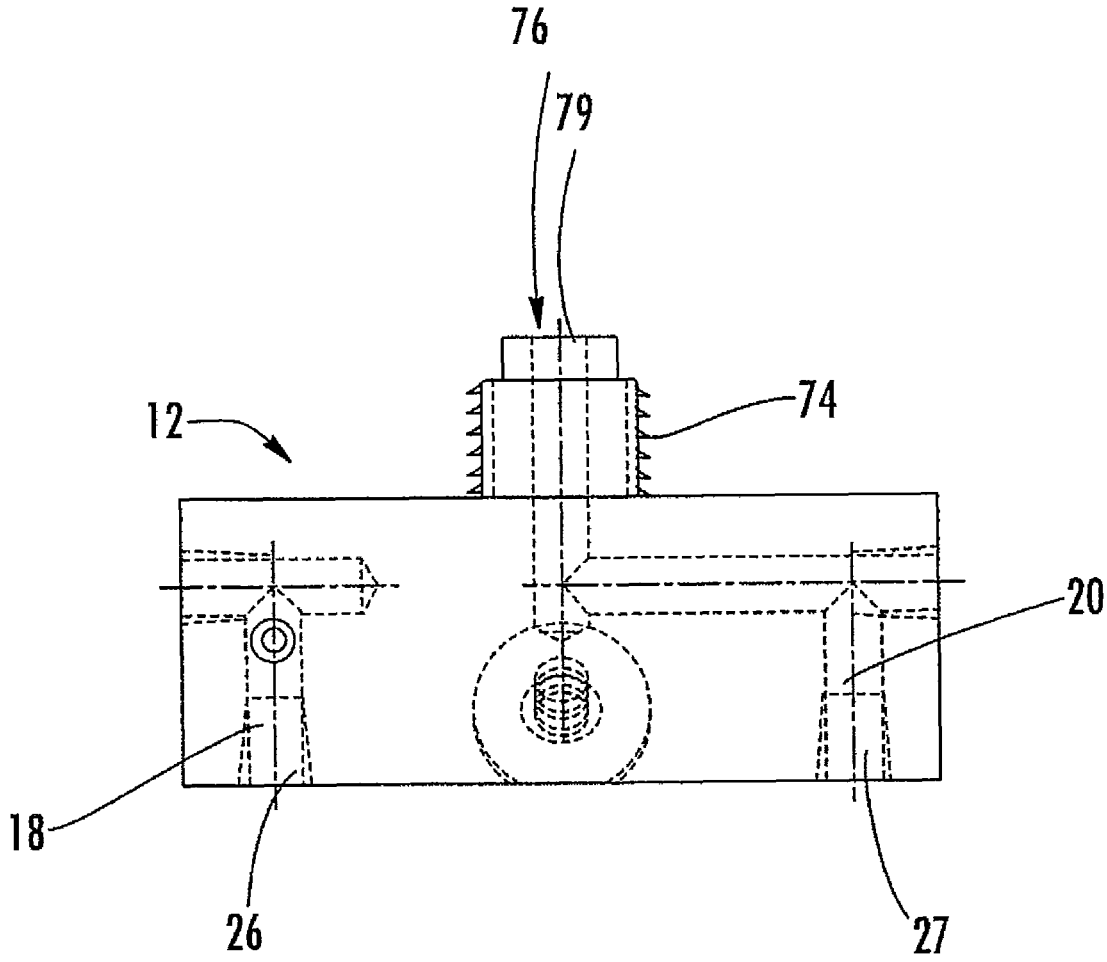
FIG. 4 is a top cross-sectional view of the manifold.

In one embodiment, the manifold 12 is tooled with channels forming two cylindrical passageways, a catalyst passageway 18 and a resin passageway 20 (FIG. 4). The resin passageway 20 begins at one end of the manifold 12 and terminates at another end of the manifold 12 where the resin is directed into the static mixing tube 82. The catalyst passageway 18 begins at one end of the manifold 12 and terminates at another end of the manifold 12 where it is directed into the pressurized air supply line 122. In alternate embodiments, the manifold 12 is not needed since the resin can be introduced directly into the static mixing tube 82 and the catalyst can be introduced directly into the air supply line 122. Preferably, these passageways 18 and 20 are not provided with check valves or O-rings. As resin and catalyst are not mixed within the manifold 12, there is no need to provide check valves to prevent backflow of catalyzed resin into the passageways 18 and 20. O-rings associated with such check valves can also be eliminated. The life of the gun 10 is thereby extended over conventional guns which must be overhauled or discarded when manifold O-rings become coated with hardened resin.

In one embodiment, the catalyst passageway 18 is connected to a pressure gauge 24 which is mounted to the exterior of the manifold 12, yet operably connected to the passageway 18 to keep the operator informed of the pressure at which the catalyst is moving through the passageway 18 (FIG. 4). The pressure gauge 24 is very effective as an alarm for the present invention, not only warning an operator of a problem, but diagnosing the problem as well.

In one embodiment, the gauge 24 measures pressures from zero to over one thousand pounds per square inch. During normal operation, the spray gun 10 is operated with a catalyst pressure of between about ninety and one hundred thirty pounds per square inch since the catalyst pressure need only match the air pressure to unseat check valve 107 and allow catalyst to flow through the system, as is further discussed below. If the pressure drops below about ninety pounds per square inch, the pump (not shown) providing catalyst to the gun 10 should be adjusted to increase the flow of catalyst through the gun 10. If the pressure quickly rises to over about one hundred thirty pounds per square inch, the gun 10 is likely blocked with a plug of resin. The gun 10 must then be cleared of any obstruction. If the pressure rises and falls between zero and a normal pressure, the catalyst pump is likely only pumping on one stroke instead of two. The pump must then be repaired to assure accurate application of catalyst and resin. Although a catalyst pressure range of between ninety and one hundred thirty pounds per square inch is given as an example, the pressure may be lower or higher depending on the particular application.

Figures 5, 6:
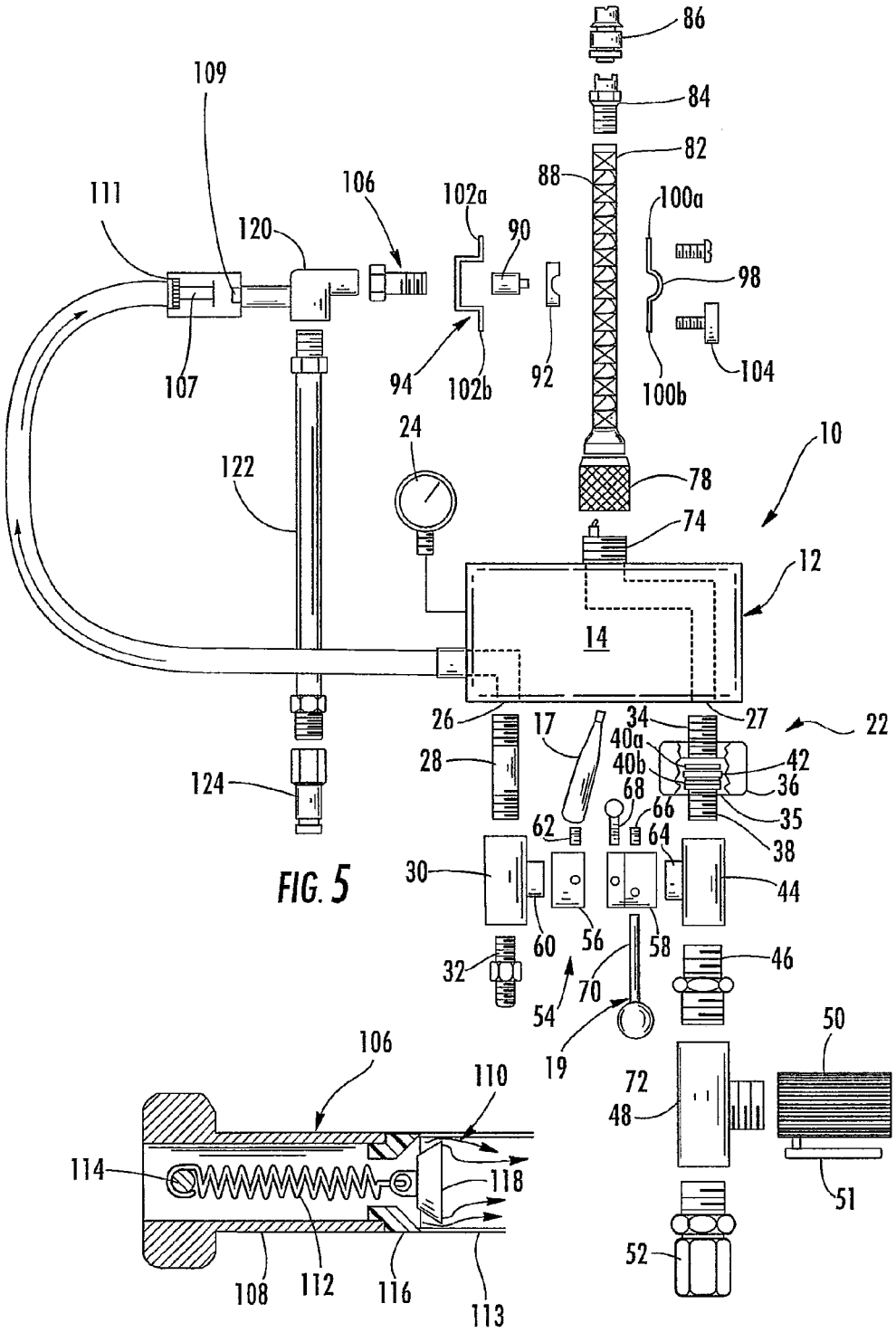
FIG. 5 is an exploded view of the spray gun.
FIG. 6 is a side cross-sectional view of the check valve.

In one embodiment, mounted to the catalyst input 26 of the manifold 12 is a stainless steel catalyst pipe nipple 28 (FIG. 5). It is very important to ensure that all parts of the device which come into contact with the catalyst are non-reactive with the catalyst. Contact of methyl-ethyl-ketone peroxide (or other catalysis) with aluminum or similar reactive material may cause a deadly explosion. The nipple 28 consists of a short section of pipe which connects the manifold 12 to a catalyst ball valve assembly 30. The catalyst ball valve assembly 30 is preferably a one-quarter inch high pressure ball valve, constructed of stainless steel to avoid reaction with the catalyst. The ball valve assembly 30 is connected to a threaded catalyst line connector 32, which allows the spray gun 10 to be connected and disconnected to a catalyst supplying apparatus (not shown). The ball valve assembly 30 thereby acts as a "trigger" or an on/off valve to start and stop the flow of catalyst through the gun 10.

In one embodiment, connected to the resin input 27 of the manifold 12 is a restricted orifice union 22 (FIG. 5). The restricted orifice union 22 consists of an orifice nipple 34, a coupling nut 36, and a resin connection pipe 38. The coupling nut 36 is in slidable engagement with the resin connection pipe 38 and prevented from coming off of the end of the resin connection pipe 38 by a flange 35 provided on the end of the resin connection pipe 38. Positioned between the orifice nipple 34 and the resin connection pipe 38 are a pair of O-rings 40*a-b* and an orifice plate 42. The orifice plate 42 is provided with an opening of a smaller diameter than the interior diameter of the orifice nipple 34. The orifice plate 42 is positioned between the orifice nipple 34 and the resin connection pipe 38 and the coupling nut 36 is screwed onto the orifice nipple 34. The coupling nut 36 is tightened until the orifice plate 42 is pressed tightly enough between the O-rings 40*a-b* to prevent the passage of resin between the O-rings 40*a-b* and the orifice plate 42.

The diameter of the hole in the orifice plate 42 is somewhat smaller than the interior diameter of the resin connection pipe 38 so that a plug passing through the resin connection pipe 38 is stopped at the orifice plate 42 before entering the manifold 12. When such a clog occurs, the force of spray from the gun 10 will substantially decrease, thereby notifying the operator that the coupling nut 36 must be removed from the orifice nipple 34. After the coupling nut 36 has been removed from the orifice nipple 34, the orifice plate 42 is removed and the resin connection pipe 38 is cleared of any obstruction. The restricted orifice union 22 thereby allows quick, in-the-field removal of plugs. The restricted orifice union 22 is extremely useful as no tools are required to remove plugs from the resin line, even in the field. It is imperative to remove plugs from the line before such plugs reach the resin passageway 20 of the manifold 12, where they would require extensive downtime to be removed (FIGS. 4 and 5).

Connected to the resin connection pipe 38 is a resin ball valve assembly 44 (FIG. 5). The resin ball valve assembly 44 is a one-quarter inch high pressure stainless steel ball valve, preferably capable of withstanding pressures up to two thousand pounds per square inch. A T-valve adapter 46 connects the resin ball valve assembly 44 to a T-valve 48. The right-angle connection of the T-valve 48 is connected to a fluid relief valve 50 which, in one embodiment, is a ⅜ inch standard ball valve. The opposite end connection of the T-valve 48 is connected to a fluid hose T-adapter 52. The fluid hose T-adapter 52 allows the spray gun 10 to be quickly connected and disconnected from a resin hose and supply apparatus. The resin relief valve 50 allows the escape of resin through the valve 50 to prevent extreme pressure from building up and damaging more delicate portions of the gun 10.

The relief valve 50 is provided with a handle 51 which opens and closes the valve 50. The handle 51 may be opened and the valve 50 placed over a reservoir of resin (not shown) to purge the line of air before spraying. The valve 50 may also be used to recycle resin which has been sitting in the line for an extended period of time to prevent settled resin from being applied to a surface.

Operably connected between the catalyst ball valve assembly 30 and the resin ball valve assembly 44 is a ball valve yoke 54, which, when rotated, simultaneously opens both the catalyst ball valve assembly 30 and the resin ball valve assembly 44 (FIG. 5). The ball valve yoke 54 is composed of two pieces, a catalyst connector 56 and a resin and handle connector 58. The catalyst connector 56 is a cylindrical piece of metal which fits over a catalyst ball valve assembly orifice control 60 and is attached thereto by means of a set screw 62.

The resin and handle connector 58 is also a cylindrical piece of steel, but fits over the resin ball valve orifice control 64 (FIG. 5). The resin and handle connector 58 is attached to the resin ball valve orifice control 64 by means of a set screw 66. The internal circumference of the free end of the resin and handle connector 58 is substantially similar to the outer circumference of the catalyst connector 56. The free end of the catalyst connector is inserted into the free end of the resin and handle connector 58 and connected thereto by means of a thumb screw 68.

A switch handle shaft 70 is secured to the resin and handle connector 58. In one embodiment, the switch handle shaft 70 is a steel rod threaded on either end. One end of the shaft 70 is screwed into the resin and handle connector 58, and a handle ball 72 is screwed onto the opposite end of the switch handle shaft 70 to make the shaft 70 easier to grasp and maneuver.

In one embodiment of the present invention, when the shaft is perpendicular to both the catalyst pipe nipple 28 and orifice nipple 34, the ball valves 30 and 44 are closed, thereby preventing the flow of either catalyst or resin into the manifold 12 of the spray gun 10. When the handle ball 72 is pushed toward the manifold 12, the catalyst ball valve assembly 30 and resin ball valve assembly 34 are opened, thereby allowing catalyst and resin to enter the catalyst and resin passageways 18 and 20 of the manifold 12 (FIGS. 4 and 5). It should be noted that other valves known in the art which are able to start and stop the flow of fluids may be used instead of the assembly described above.

Figure 2:
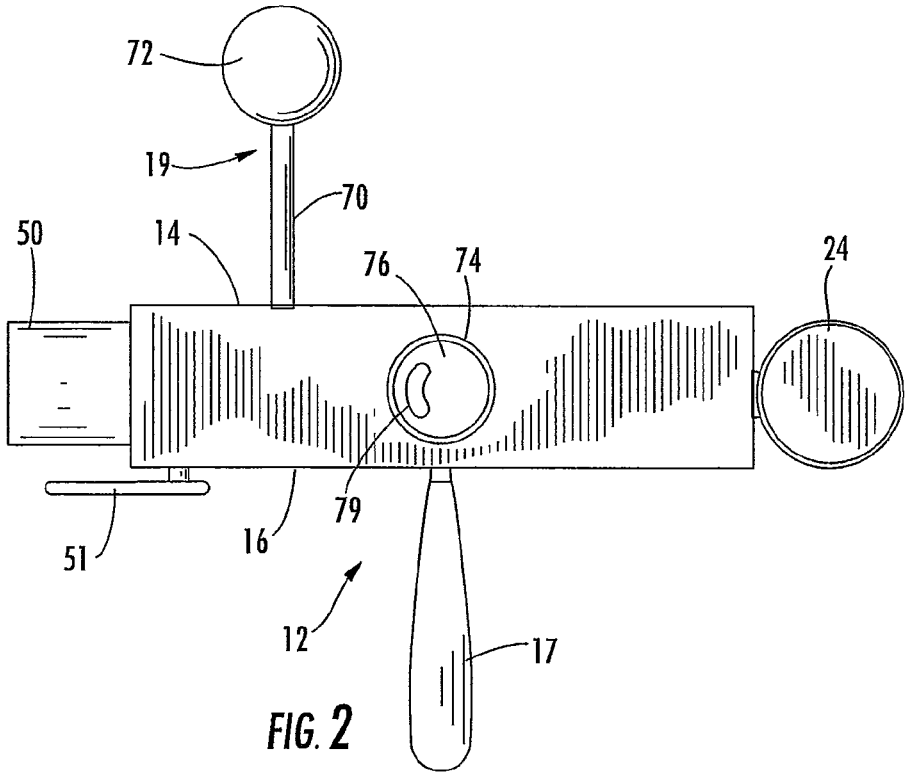
FIG. 2 is a front elevational view of the spray gun of FIG. 1 showing the static mixer removed.

In one embodiment, the resin passageway 20 emerges at the forward end of the manifold 12 at a ferrule mount 74 (FIG. 4). The ferrule mount 74 is a cylindrical protrusion extended forwardly from the output end 76 of the manifold 12. The exterior circumference of the ferrule mount 74 is threaded so that a ferrule 78 may be screwed onto and off of the manifold 12. (FIGS. 3-4) The resin passageway 20 exits from a kidney-shaped orifice 79 in the ferrule mount 74 (FIGS. 2 and 4). The resin is then introduced into the static mixing tube 82 as is further described below.

The catalyst passageway 18 emerges from the manifold 12 and is directed into the air supply line 122 (FIG. 5) at adapter 120. There is where the catalyst mixes with and is atomized and vaporized by pressurized air entering the system through the air tube 122. The catalyst passes through a screen filter 111, a first check valve 107, and a proportioning hole 109 before being combined with the air line 122. The screen filter 111 prevents large pieces of catalyst material from entering the system so that large pieces of catalyst material do not clog the proportioning hole 109 and affect the amount of catalyst entering the system. The proportioning hole 109 has a predetermined diameter than helps ensure that the proper amount of catalyst is being introduced into the air line. If more catalyst is desired, a proportioning hole 109 with a larger diameter is used. If less catalyst is desired, a proportioning hole 109 with a smaller diameter is used.

The first check valve 107 may be similar to the check valve shown in FIG. 6. The primary function of this first check valve 107 is to prevent catalyst from draining out of the catalyst supply line when the device is turned off, i.e. when no catalyst is being pumped through the system. As discussed above, prior art devices waste considerable amounts of catalyst and resin because the catalyst in the catalyst line between the on/off valve (ball valve yoke 54) and the end of the catalyst line is allowed to drain out of the catalyst line when the spray gun 10 is turned off. Prior spray guns required running catalyst and resin through them for a few moments before they could be used in order to ensure the catalyst was properly mixing with the resin, thereby wasting both resin and catalyst. The first check valve 107 of the present invention overcomes this problem because it closes when the catalyst supply is turned off thereby not allowing any catalyst to drain out of the end of the catalyst line.

One feature of the present invention is that the catalyst pressure need only match the air pressure to unseat check valve 107 and allow catalyst to flow through the system. As discussed above, many prior art devices require the catalyst pressure to match the resin pressure (which can approximate 3000 psi) to ensure resin did not back-up into the catalyst line. The design of the present invention overcomes the need to have the catalyst introduced at such a high pressure because the catalyst is introduced through the air supply line 122 and therefore only needs to match the pressure of the air being introduced, which is typically much lower than the pressure at which the resin is introduced. Typically, in the present invention, air pressure is introduced between about ninety and one hundred thirty psi and flows at about ten cubic feet per min (cfm).

After passing through the first check valve 107 the catalyst is directed to converge with the air supply line 122. In the embodiment shown in FIG. 5, this occurs in the ninety-degree adapter 120. However, it should be noted that the catalyst can be introduced into any suitable portion of the air tube 122. The catalyst then passes through a second check valve 106, and eventually into the mixing tube 82 where the atomized catalyst mixes with the resin. The second check valve 106 prevents the flow of resin from backing up into the air/catalyst supply line. The check valve 106 consists of a bolt 108 and a closure mechanism 110 (FIG. 6). The bolt 108 is hollow and is provided with a spring 112 and a spring mount 114 operably connected to both the bolt 108 and the one end of the spring 112. The opposite end of the spring 112 is connected to a frusto-conical stainless steel stopper 118. The spring 112 retains the stopper 118 in a Teflon polytetrafluoroethylene seat 116 which is secured to the circumference of the bolt 108. The Teflon polytetrafluoroethylene seat 116 is designed to engage the surface of the stopper 118 and to prevent material from passing into the bolt 108 from between the seat 116 and the stopper 118. The stopper 118 and the seat 116 are preferably constructed of dissimilar materials such as stainless steel and Teflon polytetrafluoroethylene to prevent the catalyzed resin from sealing the stopper 118 against the seat 116 during operation of the gun 10.

In one embodiment shown in FIG. 6, the walls 113 of the bolt 108 extend a predetermined distance past the seat 116. The diameter of the channel created by the extended walls 113 is slightly larger than the diameter of the stopper 118 so that the air/catalyst mixture flows between the stopper 118 and the extended walls 113 when the valve 106 is in the open position. This air flow helps to clean off and prevent the build up of any resin that has made it way to the valve's 106 stopper 118.

The check valve 106 is designed with an approximately five pound per square inch blow-off so that as soon as the pressure within the bolt 108 is five pounds per square inch greater than the pressure against the spring side of the stopper 118, the stopper 118 moves out of the seat 116 to allow air to pass out of the bolt 108. A particular advantage of this configuration is that the spring 112 is always in contact with air and never in contact with catalyzed resin. The closure mechanism 106 thereby protects itself from contamination and malfunction due to contact with catalyzed resin.

In the embodiment shown in FIG. 5, a ninety-degree adapter 120 is used to connect the check valve 106 to an air tube 122. The air tube 122 is secured to a plug quick disconnect 124. The air tube 122 is preferably secured to the manifold 12 by a bracket or similar securement means to place the plug quick disconnect 124 near the catalyst line connector 32 and the fluid hose T-adapter 52, so that all of the hose connections may be made quickly and easily.

Figure 3:
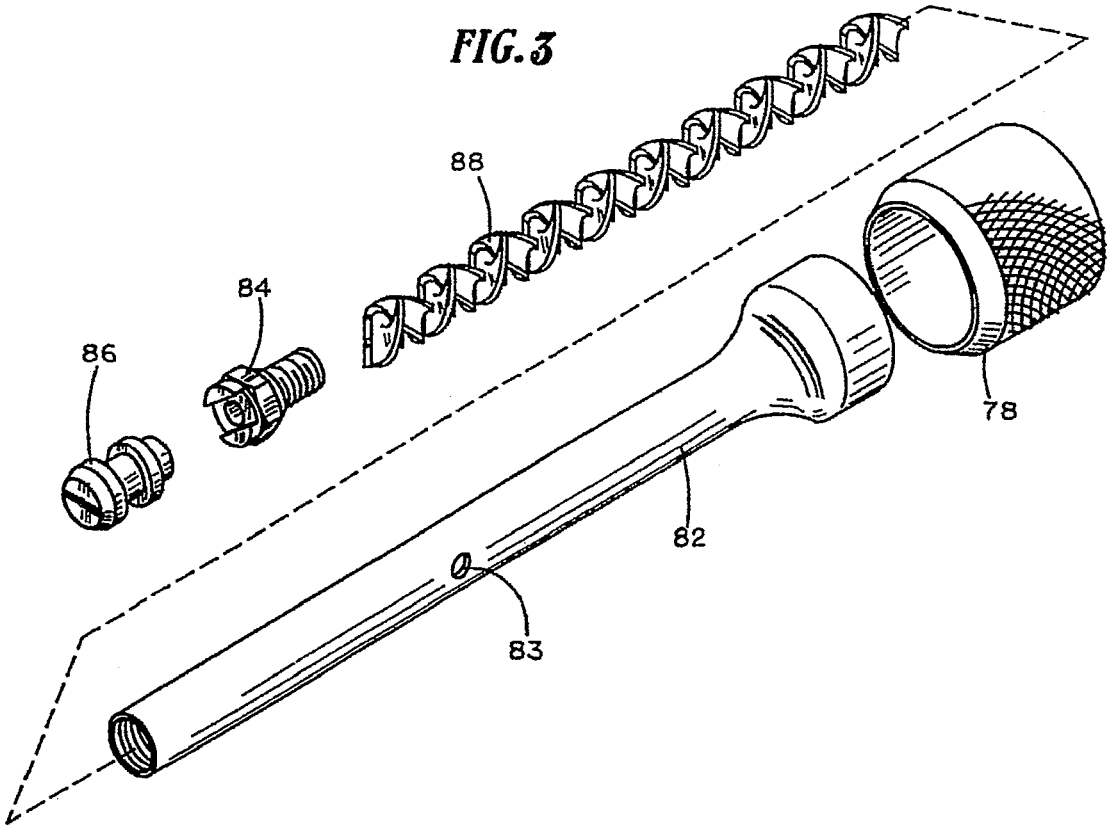
FIG. 3 is an exploded perspective view of the nozzle tip, ferrule and disposable static mixing tube.

The static mixing tube 82 is placed over the ferrule mount 74 and the ferrule 78 is placed over the mixing tube 82, slid down the tube 82, and screwed onto the ferrule mount 74 to secure the static mixing tube 82 to the manifold 12 (FIGS. 1 and 5). In one embodiment, the static mixing tube 82 is composed of an inexpensive and lightweight plastic such as polyethylene or polypropylene. These materials insure that the tube 82 does not add extraneous weight to the spray gun 10 and that the tube 82 may be disposed of each time the spray gun 10 ceases spraying resin long enough to allow the catalyzed resin to set up within the tube 82. The rearward end of the tube 82 is flanged to prevent the tube 82 from becoming detached from the manifold 12 after the ferrule 78 has been screwed into place (FIGS. 1 and 3). The forward end of the static mixing tube 82 is provided on its interior circumference with threads so that a spray tip body 84 may be screwed into the tube 82. The spray tip 86 is secured to the spray tip body 84, to controllably disburse the catalyzed resin being expelled from the spray gun 10. The threads on the static mixing tube 82 provide the spray tip 86 with the ability to be quickly disconnected from the static mixing tube 82 by hand to remove plugs during operation of the gun 10.

Placed within the static mixing tube 82 and running the entire length of the tube 82 is a spiral mixer 88 (FIG. 3). The spiral mixer 88 is preferably of a reversely flighted segmented pattern with each segment being reversely flighted from adjacent segments. This pattern is continued along the length of the spiral mixer 88 to allow homogenous mixing of the catalyst and resin as they pass through the static mixing tube 82. The tube 82 and spiral mixer 88 are preferably molded of an inexpensive plastic so that after spraying, catalyzed resin need not be removed from the tube 82. Instead of rinsing the tube 82 with a costly and hazardous solvent such as acetone, the tube is set aside until the resin hardens within the tube 82. After the resin has hardened, the tube 88 poses no more environmental hazard than a plastic stick and is simply thrown away after use. Unnecessary proliferation of toxic solvents into the environment is thereby eliminated.

The side of the static mixing tube 82 is provided with an orifice 83 into which is placed a chamfered air supply tube tip 90 (FIGS. 3 and 5). The air/catalyst mixture enters the mixing tube 82 through tube tip 90 where it mixes with the resin that is already in the mixing tube 82. The atomization and vaporization of the catalyst in the air supply line prior to its introduction with the resin helps the catalyst mix with the resin in the tube. As discussed above, some prior art devices had inefficient mixing of resin and catalyst because the catalyst and resin would create their own separate paths as they migrated through the mixing tube 82. The air pressure also helps the heavily filled system of resin, filler, and catalyst shear at the spray tip 86. A rubber tip seal 92 is placed between the tube tip 90 and the static mixing tube 82 to prevent air and catalyzed resin from escaping the static mixing tube 82 through the orifice 83 shown in FIGS. 4 and 5.

The air supply tube tip 90 is held in place by a connector assembly 94 (FIG. 5). A tube tip bracket 96 is preferably formed of a thin sheet of metal and is designed to fit around the tube tip 90 and halfway around the circumference of the static mixing tube 82. The ends of the tube tip bracket 96 extend away from the static mixing tube 82 yet parallel with one another. A securement bracket 98 is formed of a thin sheet of metal to fit securely around half of the circumference of the static mixing tube 82. The ends 100*a-b* of the securement bracket 98 extend outwardly from the static mixing tube 82 yet parallel with the ends 102*a-b* of the tube tip bracket 96. The ends 102*a-b* of the tube tip bracket 96 and ends 100*a-b* of the securement bracket 98 are supplied with holes so that they may be secured together. In one embodiment, one set of ends 100*a* and 102*a* is secured with a nut and bolt while the other set of ends 100*b* and 102*b* is secured with a much larger nob screw 104. The nob screw 104 is provided so that the connector assembly 94 may be easily manipulated by an operator in the field to release the static mixing tube 82.

To begin application of catalyzed resin, the fluid hose T-adapter 52 is connected to a line supplying a resin, such as polyester, and the catalyst line connector 32 is connected to a line supplying a catalyst such as methyl-ethyl-ketone peroxide (FIG. 5). The plug quick disconnect 124 is connected to an air supply line to begin the flow of air through the air tube 122. The spray tip 86 of the gun 10 is pointed at an article which is to be treated with the spray tip 86 kept at a distance of about twelve inches from the surface of the article. The gun 10 is firmly grasped by the handle 17, while the switch handle shaft 70 is slowly moved forward to open the ball valve assemblies 30 and 44 (FIG. 1). As catalyst and resin begin to flow through the manifold 12, the catalyst gauge 24 is monitored for proper pressure. The resin passes through the manifold 12 and into the static mixing tube 82.

The catalyst passes through the manifold 12 and into the air supply line 122 where the catalyst is atomized and then vaporized. There are several features of the invention that assist with catalyst atomization. First, the catalyst is forced through the proportioning hole 109 which helps to break the catalyst into fine particles. As noted above, the proportioning hole 109 is an opening having a small diameter (about 0.020 inches in some embodiments). Second, the screen filter 111 assists with atomizing the catalyst by forcing it through the small openings of the screen 111. Further, the introduction of the catalyst to the air helps break apart the catalyst.

There are several factors that contribute to the vaporization of the catalyst. First, the atomization of the catalyst ultimately helps the catalyst vaporize. Second, the temperature of the catalyst itself is raised since it is introduced under pressure. The higher the temperature of the catalyst, the closer it is to its vapor state. Third, in some embodiments, the air stream is heated at or above the boiling point of the catalyst to help ensure that the catalyst is vaporized before its introduction with the resin. In some embodiments, the boiling point of the catalyst is about 120 degrees Fahrenheit. In these embodiments, the air temperature is between 120 and 150 degrees Fahrenheit to vaporize the catalyst and prevent the catalyst from condensing as it travels into and through the mixing tube 82.

After atomization and vaporization of the catalyst, the catalyst/air mixture is introduced into the static mixing tube 82 where the catalyst begins reacting with the resin. Air supplied through the mixing tube tip 90 forces the catalyzed resin through the spray tip 86. As the catalyzed resin passes through the spray tip 86, the catalyzed resin is sheared and dispersed.

As the air, catalyst, and resin flow through the gun, a static charge is created and deposited on the resin particles. To create the charged particles, the gun takes advantage of electrostatic differentials between the different materials within the gun structure. In the embodiment shown in FIG. 7, the resin 204 encapsulates various shaped ceramic materials 200 that are covered with a thin metal 202 coating. The metal coating may be gold, iron oxide, silver, tungsten, nickel, palladium, platinum, or any other suitable metal. This ceramic (filler and reinforcements) material 200 may be any suitable non-metallic solid such as rock, fiber, wood, plastic fibers, non-organic fibers, hybrid carbon fibers, graphite particles (both non-fibrous and fibrous), cellulose, or biomass. However, it is important to note that the materials used in one embodiment do not include any fiberglass. A static charge is created as the air/catalyst travel through the plastic (insulating) mixing tube 82. This static charge is quickly passed onto the metal coating 202 that surrounds the ceramic material 200. In one embodiment, the catalyst is acidic, which helps with the creation of the static charge. In one embodiment, an electrolyte is used to help create the electrostatic charge. The electrolyte may be water based. The water enters the gun as vapor in the compressed air line and, as the venturi effect is generated at the point where the air converges with the catalyst, the temperature drops causing condensation of the water vapor in the air stream. This becomes the liquid base for the electrolyte in generation of the electric field.

Figure 7:
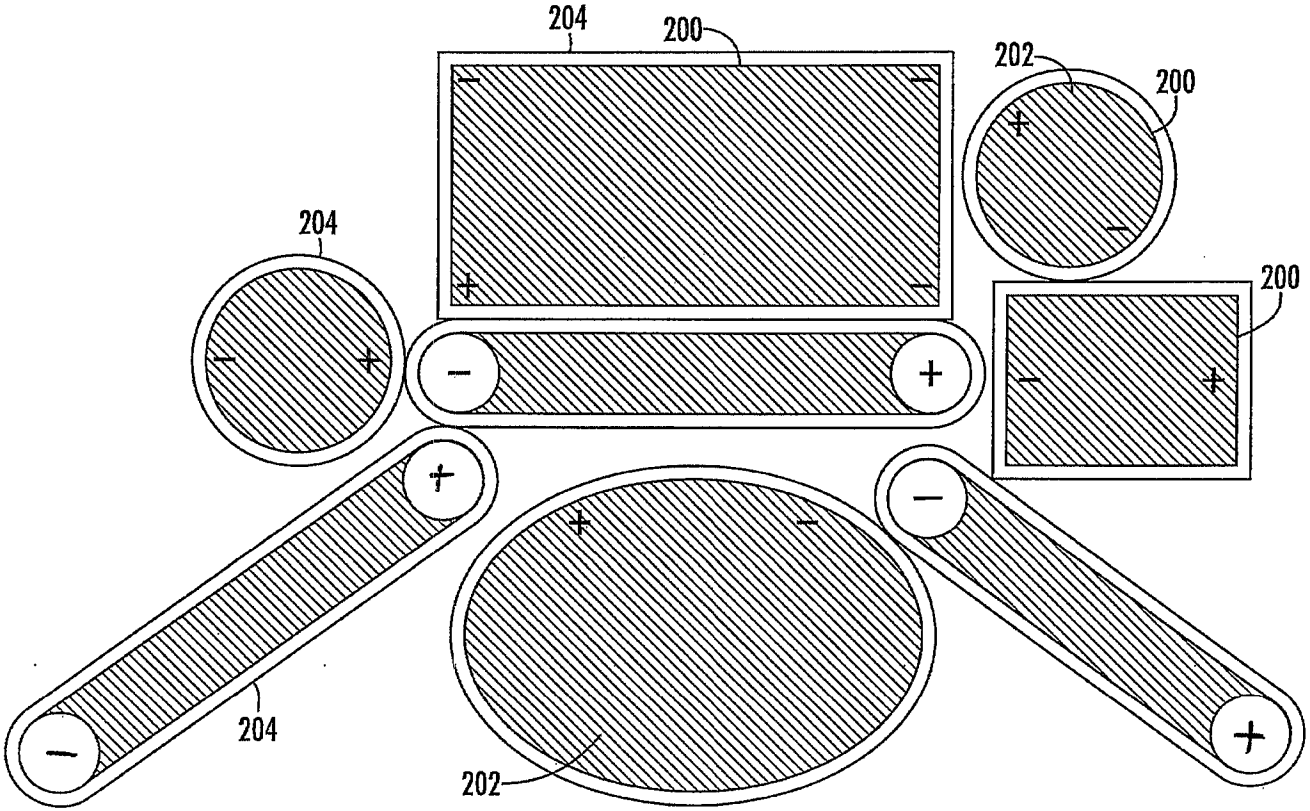
FIG. 7 is a schematic view of the material after having been expelled from the spray gun onto a substrate.

The charged resin 204 is expelled through the spray tip 86 and onto the substrate. As shown in FIG. 7, electrostatically coated molecules of the same charge repel each other and those of opposite polarity attract each other so that the resin particles are held in place as the mixture cures. The charged particles contribute to the creation of a smooth and strong finished surface. A short period after the particles are aligned, the charge dissipates.

When a particular spraying application has been completed, the switch handle shaft 70 is moved aft to terminate the flow of catalyst resin, and the air supply is thereafter shut down (FIG. 1). The thumb screw 104 is loosened to allow the air supply tube tip 90 to be pulled out of the orifice 83 in the static mixing tube 82 (FIGS. 3 and 5). The ferrule 78 is unscrewed from the ferrule mount 74, and the static mixing tube 82 is removed from the gun 10. The spray tip body 84 and spray tip 86 are removed from the static mixing tube 82, and the ferrule 78 is slid from the static mixing tube 82. The spray tip body 84, spray tip 86, and ferrule 78 are thoroughly cleaned, while the catalyzed resin remaining within the static mixing tube 82 is allowed to harden therein. Once the catalyzed resin within the static mixing tube 82 has hardened, the tube 82 no longer presents an environmental hazard and may, therefore, be disposed of in a landfill or similar depository.

The atomization and vaporization of the catalyst in the air supply line before its introduction with the resin provides thorough and even mixing in the static mixing tube 82. The catalyst need only be introduced to the system at approximately the same pressure as the air is introduced, which is significantly lower and safer than introducing the catalyst at the same pressure as the resin. The spray gun 10 allows resin in the range of one million centipoises (cps) to be applied to articles, whereas the maximum viscosity capable of being supplied by most prior art guns is only 20,000 cps. The ability to spray materials with an increased viscosity, which may or may not be heavily filled with fillers, allows layers of over one centimeter in thickness to be applied to a surface with each pass. This device also reduces the amount of solvent which must be added to the resin during manufacture. Reducing the amount of solvent added to the resin thereby reduces the amount of solvent which eventually evaporates into the air. The internal mixing nature of the present invention also reduces the amount of catalyst atomized directly into the atmosphere and allows the invention to be used in areas where the use of external mix apparatuses is prohibited or in areas where emissions are restricted by law.

The spray gun 10 allows for the elimination of any O-rings within the manifold 12. Typically spray guns have check valves located within the manifold to prevent catalyst from mixing with resin in places where the solvent flush cannot reach. These check valves generally use o-rings to obtain a tight seal against the manifold. After prolonged contact with catalyst, resin and solvent these O-rings often crack or break thereby allowing catalyzed resin by the O-rings. Once catalyzed resin has hardened around or behind the O-rings, the entire manifold must be stripped down and repaired. Furthermore, the manifold is often damaged during removal of damaged O-rings, thereby requiring replacement of the entire spray gun. As the typical spray gun may cost upwards of two thousand dollars, the elimination easily damaged parts, such as O-rings, as in the present invention is of great value to the industry.

The coating produced using the above described spray gun and method is superior to coatings produced by other methods. A number of tests were conducted on the coating product in an effort to quantify the coating's characteristics and demonstrate is superiority. The tests and results for abrasion, wear, and heat resistance are discussed below.

The wear test was performed with a TABER brand abraser. This instrument is commonly referenced in test specifications as the Rotary Platform, Double-Head (RPDH) Tester. The test piece was secured to the instrument platform, which is motor driven at a fixed speed. Two abrasive wheels are lowered onto the specimen surface, and as the platform rotates, it turns the two wheels. This causes a rub-wear action (sliding rotation) on the surface of the test-piece and the resulting abrasion marks form a pattern of crossed arcs in a circular band. A vacuum system removes debris during testing. The test was performed with 400 cycles at 1000 g loading and 60 rpm rotation speed. The results are shown in the table below, where the weight loss range is between 0.031% and 0.094%.

TABLE 1

Results from wear testing.

| Specimen | Cycles | Weight Before (g) | Weight After (g) | Weight Loss (mg) | Taber Wear # |
|---|---|---|---|---|---|
| PW-1-A | 400 | 65.2161 | 65.1637 | 52.40 | 131 |
| PW-1-B | 400 | 73.9953 | 73.9498 | 45.50 | 113.75 |
| PW-1-C | 400 | 71.3796 | 71.3126 | 67.00 | 167.5 |
| C1-CL-A | 400 | 59.9972 | 59.9765 | 20.70 | 51.75 |
| C1-CL-B | 400 | 66.7528 | 66.7321 | 20.70 | 51.75 |
| C1-CL-C | 400 | 75.8692 | 75.8431 | 26.10 | 65.25 |
| AR-1-CL-A | 400 | 75.0214 | 74.9777 | 43.70 | 109.25 |
| AR-1-CL-B | 400 | 83.4633 | 83.4121 | 51.20 | 128 |
| AR-1-A | 400 | 84.9216 | 84.8742 | 47.40 | 118.5 |
| AR-1-B | 400 | 137.9173 | 137.8878 | 29.50 | 73.75 |

Another test performed on the resultant coating product was a test demonstrating the product's heat resistance. This test was performed according to the DTRC Burn-Through Test MIL-STD2031 adopted as the standard for the U.S. Navy. Each panel of test product was exposed to a propane flame having a diameter of 38 mm and a distance from the panel of 203 mm for 30 minutes. The flame spread at the panel surface was measured at 100 mm in diameter. The temperature at the panel surface was measured at 800 degrees Celsius and the heat flux at the panel surface was 80 $kW/m^2$. After the flame was removed, the weight loss was measured from each test panel with the result being between about 12 and 20% mass loss In one embodiment, the product produced using the spray gun and method has the following characteristics:

TABLE 2 product's characteristics in certain embodiments

| Type of Test | American Society of Testing and Materials (ASTM)Number | Result |
|---|---|---|
| Hardness | | Barcol: 80<br>Hoh: 9F |
| Compressive Strength | D-759 | 16,000 psi |
| Tensile Strength | D-307 | 9,500 psi |
| Flexural Strength | D-790 | 21,300 psi |
| Modulus of Elasticity | D-790 | $.9 \times 10^6$ |
| Coefficient of Thermal Expansion | | $6.5 \times 10^{-6}$ |
| Bond Strength | | Concrete: >400 psi (concrete fails before the bond)<br>Steel: 1,200 psi |
| Indentation | | MIL-D-3143F None |

TABLE 2-continued product's characteristics in certain embodiments

| Type of Test | American Society of Testing and Materials (ASTM)Number | Result |
|---|---|---|
| Heat Resistance | | 400° F. Continuous<br>600° F. Transient |
| Flammability | | UAB-DRC-MIL-STD: 2031 Self Extinguishing after 30 min. exposure (800° F.) |
| Water Solubility | | 0.0095 |
| Abrasion Resistance | D-4060 | CS-17 Wheel: 0.020 gm |

The foregoing description and drawings merely explain and illustrate the invention, and the invention is not limited thereto, except insofar as the claims are so limited, as those skilled in the art who have the disclosure before them will be able to make modifications and variations therein without departing from the scope of the invention.

What is claimed is as follows:

1. A method for applying a coating to a substrate by spraying a first material in confluence with a second material and a pressurized gas, said method comprising: introducing the second material to the pressurized gas before mixing the second material with the first material; vaporizing second material before mixing the second material with the first material; creating a static charge on the second material; combining the first material with the second material in a mixing tube to initiate a chemical reaction between the two materials producing a resultant material having particles, wherein the charge is at least partially transferred from the second material onto the resultant material; expelling the materials from the mixing tube onto the substrate whereon the particles of the resultant material align according to charge;

wherein the mixing tube is made from a non-conductive material;

wherein the second material is a catalyst, and the static charge is created using the electrostatic differentials between the catalyst and the mixing tube;

wherein the first material comprises a metal coating.

2. The method of claim 1 wherein the second material has a vaporization temperature and the pressurized gas is heated to at least the vaporization temperature of the second material before the second material is introduced to the gas.

3. The method of claim 1 wherein the second material is introduced to the pressurized gas under pressure to assist with vaporization.

4. The method of claim 1 wherein the second material is acidic to assist with the creation of the charge.

5. The method of claim 2 wherein the first material is a resin.

6. The method of claim 1 wherein the pressurized gas is air.

7. The method of claim 1 wherein the charge dissipates after the resultant material particles align.

8. The method of claim 1 wherein the first material does not contain any fiberglass.

9. The method of claim 1 wherein the particles of the resultant material align according to charge to create a lattice structure.

10. The method of claim 1 wherein the charge holds the particles of the resultant material in place as the resultant material cures.

11. The method of claim 1 wherein the second material and gas are introduced to each other at approximately the same pressure, which pressure is lower than the pressure at which the first material is introduced into the mixing tube.

12. A method for applying a coating to a substrate by spraying a first material in confluence with a second material and a pressurized gas, said method comprising: introducing the second material to the pressurized gas before mixing the second material with the first material; vaporizing second material before mixing the second material with the first material; creating a static charge on the second material; combining the first material with the second material in a mixing tube to initiate a chemical reaction between the two materials producing a resultant material having particles, wherein the charge is at least partially transferred from the second material onto the resultant material; expelling the materials from the mixing tube onto the substrate whereon the particles of the resultant material align according to charge;

wherein the first material comprises a metal coating.

13. The method of claim 12 further comprising the step of transferring the charge to the metal coating.

* * * * *